US007299923B2

(12) United States Patent
Skilliter

(10) Patent No.: US 7,299,923 B2
(45) Date of Patent: Nov. 27, 2007

(54) CONTAINER FOR GLASS PARTS AND ACCESSORIES

(75) Inventor: William J. Skilliter, Curtice, OH (US)

(73) Assignee: Pilkington North America, Inc., Toledo, OH (US)

( * ) Notice: Subject to any disclaimer, the term of this patent is extended or adjusted under 35 U.S.C. 154(b) by 56 days.

(21) Appl. No.: 11/333,901

(22) Filed: Jan. 17, 2006

(65) Prior Publication Data

US 2006/0163102 A1 Jul. 27, 2006

Related U.S. Application Data

(60) Provisional application No. 60/646,325, filed on Jan. 24, 2005.

(51) Int. Cl.
*B65D 85/48* (2006.01)

(52) U.S. Cl. ..... 206/448; 211/41.14

(58) Field of Classification Search ..... 206/335, 206/448, 449, 454, 501, 504, 509; 211/41.1, 211/41.14, 41.2, 41.15, 88.01, 88.02, 126.4, 211/126.12, 186, 188, 194; 53/452, 467, 53/473, 474

See application file for complete search history.

(56) References Cited

U.S. PATENT DOCUMENTS

| | | | | |
|---|---|---|---|---|
| 2,349,385 | A * | 5/1944 | Snelling | 211/126.12 |
| 2,690,285 | A * | 9/1954 | Main | 206/509 |
| 3,252,582 | A * | 5/1966 | Kesilman et al. | 211/41.2 |
| 3,599,558 | A * | 8/1971 | Goldberg | 211/41.2 |
| 5,316,207 | A * | 5/1994 | Ross et al. | 229/122.24 |
| 5,415,344 | A * | 5/1995 | Harrelson | 229/169 |
| 5,927,506 | A | 7/1999 | Young et al. | |

* cited by examiner

*Primary Examiner*—Luan K Bui
(74) *Attorney, Agent, or Firm*—Marshall & Melhorn, LLC

(57) ABSTRACT

A multi-part, multi-use container, having a larger, lower portion, particularly suitable for transporting large, relatively heavy items, such as vehicle glazings, and a smaller, upper portion particularly suitable for transporting accessories for use with vehicle glazings is disclosed. The upper portion of the container is formed from a combination of a plurality of vertically extending support members arranged in a predetermined pattern, and one or more horizontal support trays having slots formed therein in locations to coincide with the locations of, at least, a portion of the vertically extending support members, in order to form an interlocking structure of one or more tiers suitable for transporting, without damage, accessory items such as flexible polymeric gaskets.

18 Claims, 5 Drawing Sheets

CONTAINER FOR GLASS PARTS AND ACCESSORIES

This application claims priority of a U.S. provisional application Ser. No. 60/646,325, filed on Jan. 24, 2005.

FIELD OF THE INVENTION

The present invention is related to a container capable of transporting vehicle glazings along with accessory parts which will later be applied to the glazing prior to installation into a vehicle. More particularly, the invention relates to a container made, primarily, of corrugated materials capable of simultaneously transporting automotive glazings and a greatly increased quantity of polymeric gaskets over known containers. The fragile polymeric gaskets are transported in such a way that they are not damaged, and maintain a shape close to their intended configuration when applied to the vehicle glazing. The invention also encompasses a method of transporting glass sheets and polymeric gaskets utilizing such a container.

BACKGROUND OF THE INVENTION

There has been a significant change in the auto glass industry to eliminate expensive molded/encapsulated window edge trim and replace it with inexpensive thermoset plastic extruded cross-sections secured with an adhesive, preferably an adhesive tape. This extrusion is known as "lace."

Lace resembles very thin plastic gaskets that cover the top and pillar sections of the glass. In their natural state prior to assembly, the lace is very flexible and is similar to rope. A difficulty in shipping these fragile extrusions is that, for example, corners will deform and take a memory set if not properly supported. When the extrusion is applied to the glass, the deformed corner will not seat properly and creates a water leak or road noise vibration. Therefore, it is very important to store and ship the lace in a "draped" configuration which supports the entire top edge and corners, thus preventing deformation.

Typically, a corrugated box with an interior shelf to hold the lace is the preferred containerization. Unfortunately, it is typical to only pack 75 to 250 pieces in such a box. The boxes are large and bulky because they must be similar in size to the final glass shape; generally on the order of 48×48×48 inches tall. The boxes typically are used one-way because the freight costs are prohibitive to return the empty boxes to the supplier.

In order to fully utilize the capabilities of such a large container, particularly with respect to the proper transport of 2 to 3 times the items of lace as are possible in conventional containers, it would be desirable to have a simple, cost-effective container for this purpose.

SUMMARY OF THE INVENTION

A multi-part container having a first/lower portion comprising the majority of the total volume of the container, for transporting vehicle glazings, and a second/upper portion comprising the minority of the total volume of the container comprising of one or more horizontal support trays, having slots of predetermined length and width formed therein, and a plurality of vertically extending support members arranged in a suitable configuration, preferably lines and rows, creating unobstructed channel areas intervening between the lines and rows of vertically extending support members which are attached to a first horizontal support tray, the upper major surface of the first horizontal support tray forming the horizontal support surface of the channel areas, the channel areas being capable of accepting a plurality of accessory parts, such as the aforementioned polymeric gaskets.

Additional horizontal support trays may be brought into contact with the vertically extending supports in a manner that allows a predetermined portion of a plurality of the vertically extending supports to extend through the slots in the horizontal support tray for a predetermined distance, until coming into supporting contact with horizontal tray support portions of the vertically extending support members. In this configuration, for example, the second horizontal support tray is suspended by the vertically extending support member a predetermined distance above the first horizontal support tray, thus accommodating, for example, the polymeric gaskets placed therebetween.

Still more horizontal support trays may be added as previously described, the total number being limited by the height of the vertically extending support members and the total height of the multi-part container.

DETAILED DESCRIPTION OF THE PREFERRED EMBODIMENTS

The present invention is a multi-use, multi-part container, having as major components an outer portion comprising various panels made of for example, corrugated materials, particularly corrugated cardboard, the major panels being a base or bottom portion, one or more protective side panels, and a lid or cover. The configuration of the outer panels is not new to the art, and the overall dimensions of the container are, typically, 48 inches high, 48 inches wide, and 48 inches long.

Figure 1:
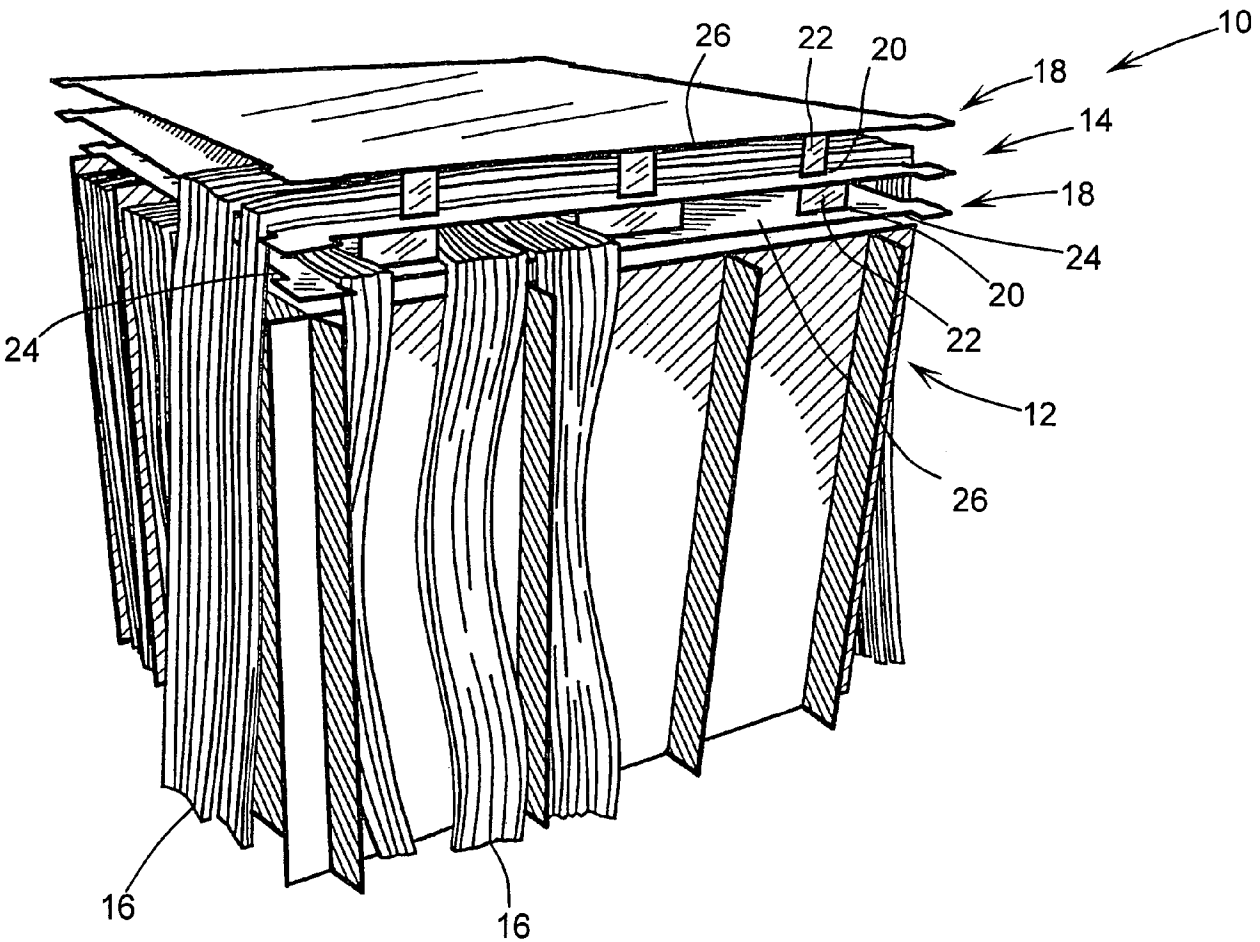
FIG. 1 is a perspective view of the container of the invention without its exterior corrugated covering.

The inner portion of the container 10, as shown in FIG. 1, has as major portions, a first/lower portion 12 comprising the majority of the total volume of the container, which first portion 12 primarily functions to transport vehicle glazings, and an adjacent second/upper portion 14 comprising a minority of the total volume of the container, which second portion 14 primarily functions to transport accessory parts for the vehicle glazings, for example, flexible polymeric gaskets, also known as "lace" 16, which will, after transport of the container, be affixed to the accompanying vehicle glazings, or other separately transported vehicle glazings. Other possible configurations of the interior components of the present container, are possible however.

It has been found to be difficult to transport the aforementioned lace 16 because it is typically formed of thermoset plastic material, such as polyvinylchloride (PVC), which once deformed, does not readily return to its original shape. Such deformation, whether involving large portions of a particular item of lace 16, or a small portion, such as a corner, can cause significant problems in obtaining a proper fit of the lace 16 on a vehicle glazing, thus potentially resulting in air or water leakage, among other problems. Accordingly, the ability to transport the lace 16 without deformation is quite important.

It is also important to be able to transport such accessory parts in greater numbers, without damage, than has heretofore been possible. The cost savings of utilizing a single container to transport, for example, 500, or even 750 items of lace 16 would provide a significant cost advantage.

To accomplish the foregoing objectives, the present invention utilizes a combination of horizontal support trays and vertically extending support members assembled in interlocking fashion to provide unobstructed spaces of sufficient height and width to accommodate a plurality of items of lace, or other like accessories, without deformation.

Figure 2:
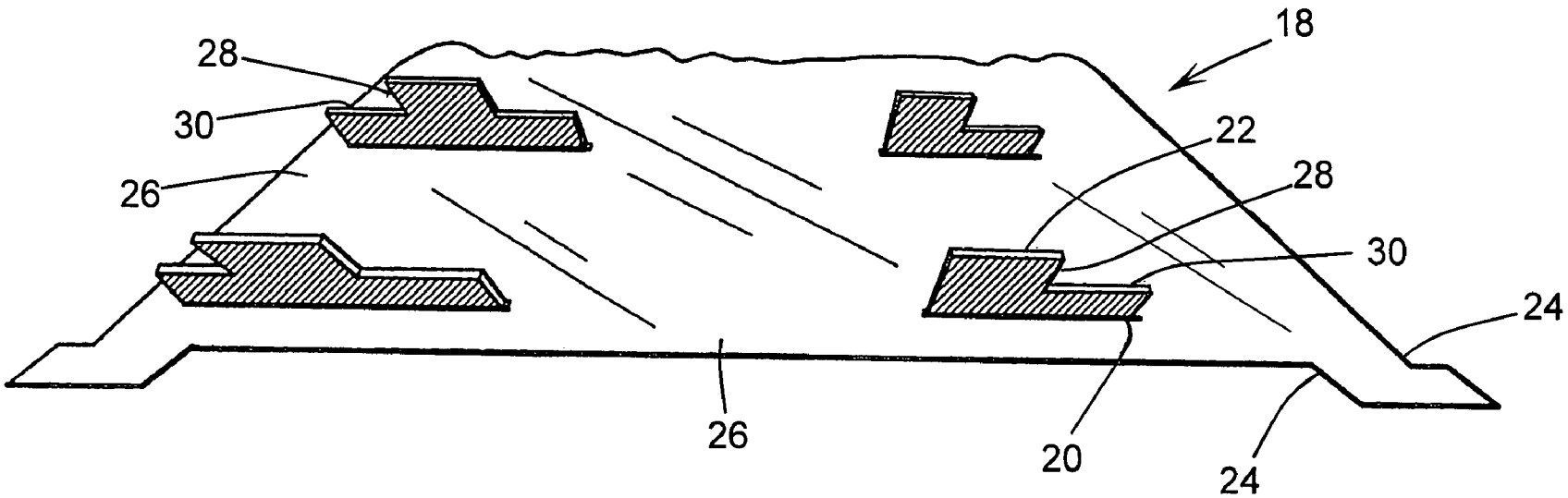
FIG. 2 is a perspective view of the portion of the container for transport of accessory parts, particularly highlighting a horizontal support tray and several vertically extending supports projecting through the slots formed in the horizontal support tray.
Figure 3:
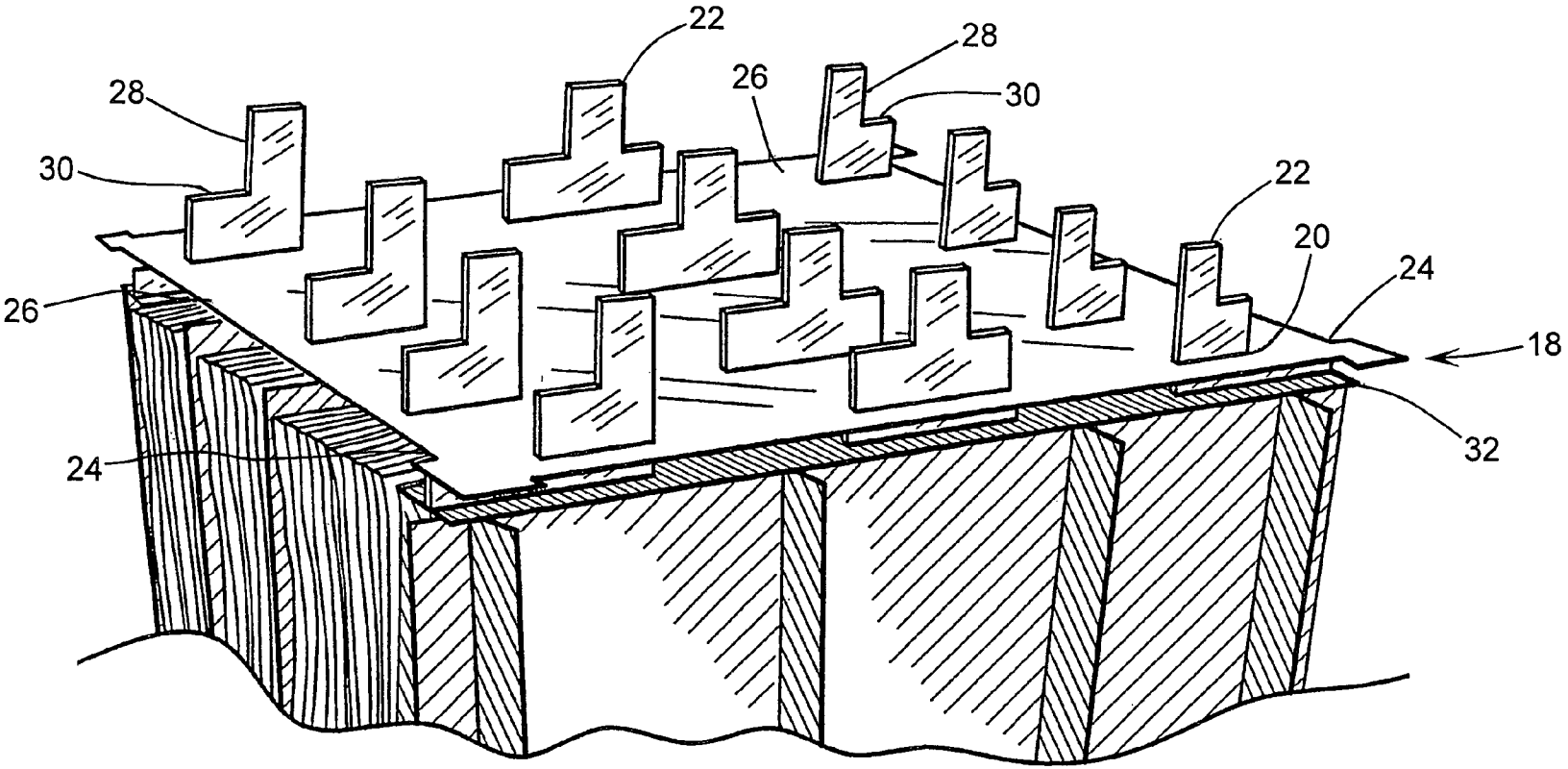
FIG. 3 is a different perspective view than FIG. 2 showing an entire horizontal support tray, and the entire array of vertically extending support members, as well as one tier of polymeric gaskets loaded for transport.

The horizontal support tray or trays 18, as shown from various perspectives in FIGS. 1-3, is an, essentially, flat piece of material, preferably a corrugated or foam core material having significant strength and rigidity. Slots 20 of a predetermined length and width are formed in the horizontal support trays 18 in locations and in a proper orientation to allow at least a predetermined portion of a plurality of the vertically extending support members 22 to project therethrough. Insets 24 in varying configurations may horizontally be cut in one or more of the edges of the horizontal support tray 18 to prevent the items of lace from moving horizontally and sliding off the support tray 18. Edges of the insets 24 may be coated with a protective material, or a protective material may be inserted between the edge of the inset and a piece of lace coming in contact therewith to prevent chafing/marring of the surface of the lace 16.

Portions of the horizontal support tray or trays 18 will, as explained later in greater detail, serve as the channels 26 upon which the lace items 16 are transported. Thus, in reference to the horizontal support trays 18, the "support" is primarily directed to support of the lace 16 items, as opposed to the vertically extending support members 22, which primarily support the horizontal support trays 18.

The vertically extending support members 22 may be formed in various shapes, but preferably in "stair step" or "L" shaped and "T" shapes. The vertically extending support members 22 may be made from any suitable material, but are preferably made from corrugated or foam core materials. Most preferably, the vertically extending support members 22 are made from the same material as the horizontal support trays 18. Edges of the vertical support members 22 which come in contact with items of lace may also be protectively coated or otherwise prevented from chafing or marring the surface of lace 16 contacting a particular support member.

The vertically extending support members 22 each have a vertical "riser" portion 28 as with a stair step, as best seem in FIGS. 2 and 3. Equivalent to the horizontal "tread" portion of a stair step, the vertically extending support members have horizontal tray support portions 30. The "T" shaped support members are utilized when more horizontal support is desired.

The vertically extending support members are attached preferably by application of a suitable adhesive to a "base" horizontal support tray 32, as best seen in FIG. 3. The vertically extending support members are arranged on the base in parallel "lines" and "rows." Lines projected along the "lines" and "rows" would thus form a grid pattern. The objective of such an arrangement is to provide uniform support for the horizontal support tray or trays 18, but at the same time, to provide the maximum unobstructed space, or "channels" 26, in between the supports 22 to allow placement of a plurality of items of lace 16 thereon. Such channels 26 may be better envisioned by projecting imaginary vertical planes up through such "row" or "line" of vertically extending support members 22.

Once the desired number of items of lace 16 are placed on the "base" horizontal support tray 32, one or more additional horizontal support trays 18 may be added to form additional "tiers" for placement of additional items of lace 16. This is accomplished by engaging the slots 20 formed in a horizontal support tray 18 with the plurality of vertically extending support members 22. In such engagement, the horizontal support tray 18 slides down over the "riser" portion 28 of the vertical support members 22, until it comes into resting contact with the horizontal tray support portion 30 of the vertically extending support members 22. At this point, the horizontal support tray 18 and the vertically extending support members 22 are, essentially, interlocked. This arrangement is best illustrated in FIGS. 1 and 3.

As previously noted, the distance between the horizontal surfaces formed by the horizontal support trays 18, as suspended/supported by the vertically extending support members 22, is important to avoid damage/deformation of the items of lace.

Generally, it is preferred that the vertical distance between "tiers" of the lace 16 transport structure be on the order of twice the height of the lace item being transported. It has also been found to be advantageous to arrange the items of lace on each "tier" at 90° to the previous tier as shown in FIGS. 1 and 3. In this way, the number of items of lace 16 packed is maximized, while minimizing the possibility of damage/deformation. Other arrangements of the items of lace are possible with varying arrangement of the vertical support members.

Figure 4:
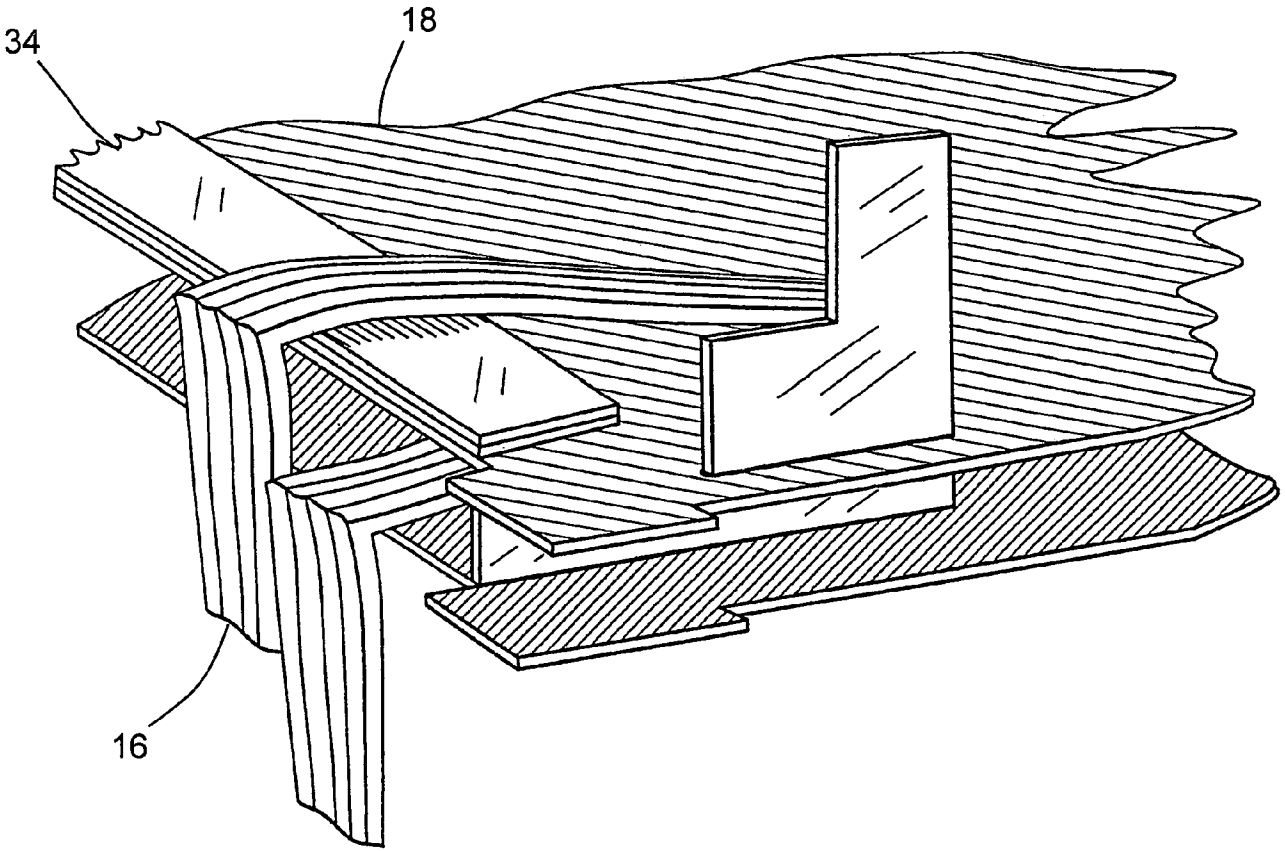
FIG. 4 shows an optional configuration utilizing a so-called wedge block for thicker and heavier than normal polymeric gaskets.

As an optional feature, for thick and heavy items of lace, wedge blocks 34, also known as build-up blocks may be attached to the horizontal support trays 18 extending along two or more of the peripheral portions of the horizontal support trays 18. Such blocks 34 create a natural sagging of the items of lace thus creating a natural sweep toward the center of the item of lace 16. This has been found to be advantageous, as the sag is designed to mimic the shape of the vehicle glazing to which the item of lace to the vehicle glazing. This concept is illustrated in FIG. 4.

Figure 5:
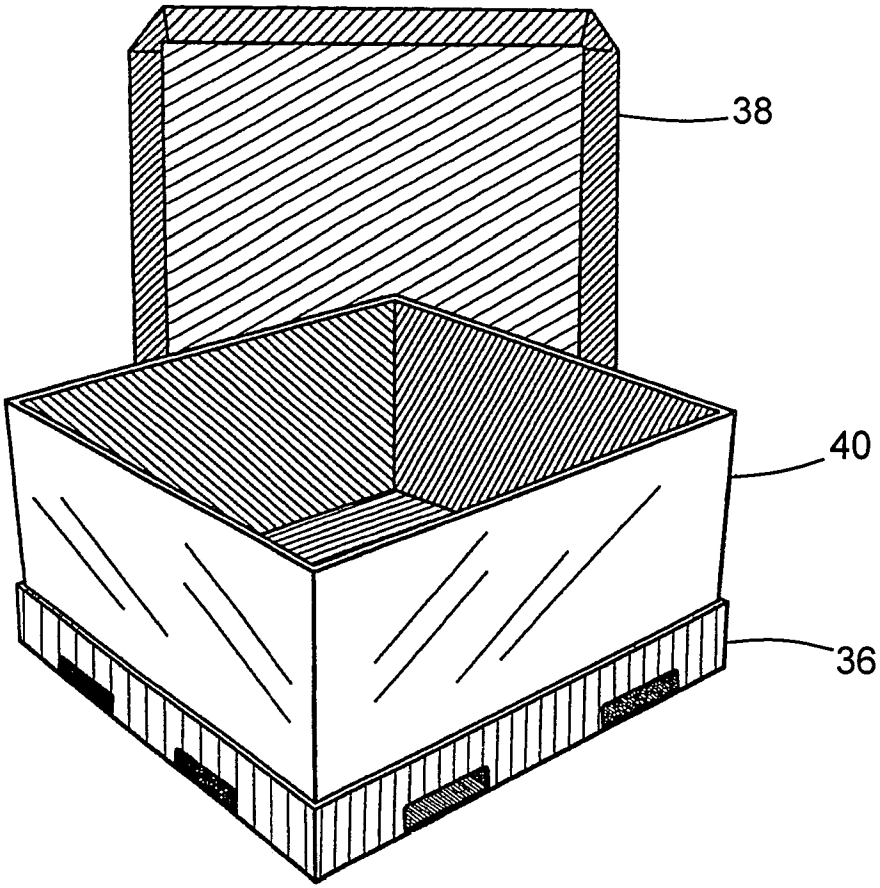
FIG. 5 shows the outer bottom, lid and side panels which are components of the present container.

FIG. 5 illustrates the base 36, top or lid 38, and protective side panel components 40 which comprise the exterior portion of the present container. These components are preferably formed from corrugated materials. Portions of each of these components may be reinforced to increase strength and durability. The components are also preferably constructed so as to be collapsible for return transport. For example, removal of the vertically extending support members from the slots in the horizontal support trays allows for compact transport of these components. Similarly, disassembly of the protective side panels allows for them to be transported in a relatively small amount of space. As will be noted, the base component is configured to allow access by the forks of a forklift truck, or other like vehicle.

It will be understood that each of the components described above, or two or more together, may also find a useful application in other types of structures differing from the types described above.

While the invention has been illustrated and described in its preferred embodiments, it is not intended to be limited to the details shown, since various modifications and structural changes may be made without departing from the spirit and scope of the present invention.

What is claimed:

1. A multi-part, multi-purpose container comprising:

a first/lower portion carrying at least one automotive glazing; and a second/upper portion supported by the first/lower portion, the second/upper portion comprising:

a first horizontal support tray;

a plurality of vertically extending support members secured to the first horizontal support tray in a predetermined configuration; and a second horizontal support tray having slots of a predetermined length and width formed therein so as to coincide with the location of the vertically extending support members, the slots being capable of being brought into interlocking contact with the vertically extending support members;

the second horizontal support tray being spaced a predetermined distance above the first horizontal support tray, such distance being determined by the configuration of the vertically extending support members; wherein one or more of the first and second support trays carry at least one automotive glazing accessory.

2. The multi-part, multi-purpose container defined in claim 1, wherein the first and second horizontal support trays comprise a corrugated material.

3. The multi-part, multi-purpose container defined in claim 2, wherein the corrugated material comprises corrugated cardboard.

4. The multi-part, multi-purpose container defined in claim 1, wherein the first and second horizontal support trays comprise a foam core material.

5. The multi-part, multi-purpose container defined in claim 1, wherein the vertically extending support members comprise a corrugated material.

6. The multi-part, multi-purpose container defined in claim 1, wherein the vertically extending support members comprise a foam core material.

7. The multi-part, multi-purpose container defined in claim 1, wherein the first and second horizontal support trays are square or rectangular in shape.

8. The multi-part, multi-purpose container defined in claim 1, wherein the vertically extending support members are "L" shaped or "T" shaped.

9. The multi-part, multi-purpose container defined in claim 8, wherein the edges of the vertically extending support members are protectively coated.

10. The multi-part, multi-purpose container defined in claim 1, wherein the second horizontal support tray is uniformly supported by vertically extending support members arranged in lines and rows to form a grid of unobstructed spaces.

11. The multi-part, multi-purpose container defined in claim 1, wherein each of the first and second horizontal support trays carry at least one automotive glazing accessory and further wherein the at least one automotive glazing accessory is arranged on the second horizontal support tray at an angle of 90° relative to the at least one automotive glazing accessory arranged on the first horizontal support tray.

12. The multi-part, multi-purpose container defined in claim 1, wherein wedge blocks are attached to two or more peripheral edge portions of the at least one horizontal support trays.

13. The multi-part, multi-purpose container defined in claim 1, wherein a base panel, a top panel and side panels comprising exterior protection panels comprise components of the container.

14. The multi-part, multi-purpose container defined in claim 13, wherein the components are collapsible.

15. The multi-part, multi-purpose container defined in claim 1, wherein the at least one automotive glazing product is one chosen from the group consisting of:

a windshield, a backlite, a sidelite and a sunroof.

16. The multi-part, multi-purpose container defined in claim 1, wherein the at least one automotive glazing accessory comprises a flexible polymeric gasket.

17. The multi-part, multi-purpose container defined in claim 11, wherein the at least one automotive glazing accessory comprises a flexible polymeric gasket.

18. A method of utilizing a multi-part, multi-purpose container for simultaneously transporting automotive glazings and accessory parts therefor, comprising:

providing a container comprising:

a first/lower portion; and a second upper portion on the first lower portion, the second/upper portion comprising a first horizontal support tray, a plurality of vertically extending support members secured to the first horizontal support tray in a predetermined configuration, and a second horizontal support tray having slots of a predetermined length and width formed therein so as to coincide with the location of the vertically extending support members, the slots being capable of being brought into interlocking contact with the vertically extending support members, the at least second horizontal support tray being spaced a predetermined distance above the first horizontal support tray, such distance being determined by the configuration of the vertically extending support members;

loading at least one automotive glazing product into the first/lower portion of the container; and loading at least one automotive glazing accessory onto at least one of the first and second horizontal support trays.

* * * * *